US008074979B2

(12) United States Patent
Kawamoto

(10) Patent No.: US 8,074,979 B2
(45) Date of Patent: Dec. 13, 2011

(54) SHEET FEED TRAY AND IMAGE FORMING APPARATUS

(75) Inventor: Hisashi Kawamoto, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 98 days.

(21) Appl. No.: 12/385,043

(22) Filed: Mar. 30, 2009

(65) Prior Publication Data

US 2009/0243196 A1 Oct. 1, 2009

(30) Foreign Application Priority Data

Mar. 31, 2008 (JP) ..... 2008-090535
Dec. 25, 2008 (JP) ..... 2008-329893

(51) Int. Cl.
*B65H 1/08* (2006.01)

(52) U.S. Cl. ..... 271/147

(58) Field of Classification Search ..... 271/22, 271/24, 30.1, 128, 147, 148, 156; 221/226, 221/279

See application file for complete search history.

(56) References Cited

U.S. PATENT DOCUMENTS 6,283,469 B1 9/2001 Weber

FOREIGN PATENT DOCUMENTS

| | | | |
|---|---|---|---|
| JP | 4-79832 | * | 7/1992 |
| JP | 5-270667 | * | 10/1993 |
| JP | 10-007265 | | 1/1998 |
| JP | 10-035928 | | 2/1998 |
| JP | 10-297771 | | 11/1998 |
| JP | 2000-153926 | | 6/2000 |
| JP | 3542689 | | 4/2004 |

OTHER PUBLICATIONS

Abstract of JP 10-035928 published Feb. 10, 1998.
Extended Search Report for corresponding European patent application No. 09250911.6 dated Sep. 14, 2011.

* cited by examiner

*Primary Examiner* — Stefanos Karmis
*Assistant Examiner* — Thomas Morrison
(74) *Attorney, Agent, or Firm* — Harness, Dickey & Pierce, P.L.C.

(57) ABSTRACT

A sheet feeding tray includes a frame member, and freely upwardly swingable plural bottom plates arranged on the frame member side by side perpendicular to a sheet feeding direction. The bottom plates cooperatively support a stack of envelope recording mediums. A lifting device having plural curvature sections is provided. The plural curvature sections are respectively arranged below the bottom plates to scuff and lift the lower surface of the plural bottom plates at a section downstream of the sheet feeding direction. The plural curvature sections each include a different outline in accordance with a difference of a decreasing amount of a thickness of the stack during sheet feeding. The different outlines enable the topmost surface of the stack to be almost horizontal.

8 Claims, 15 Drawing Sheets

SHEET FEED TRAY AND IMAGE FORMING APPARATUS

CROSS REFERENCE TO RELATED APPLICATION

This application claims priority under 35 USC §119 to Japanese Patent Application Nos. 2008-090535 and 2008-329893, filed on Mar. 31 and Dec. 25, both 2008, the entire contents of which are herein incorporated by reference.

BACKGROUND OF THE INVENTION

1. Field of the Invention

The present invention relates to an image forming apparatus and a duplicator, such as a copier, a fax, a printer, etc., and in particular, to a sheet feed tray capable of accurately holding a leading end of the topmost surface of a stack bundle of envelop like recording or printing mediums at its leading end in a sheet feeding direction at a prescribed position of a separation or conveyance mechanism while providing fine quality of constant conveyance.

2. Discussion of the Background Art

Different from a case of a plain sheet, when plural envelope like printing mediums, such as a medicine envelop, a mailing envelope, etc., are stacked in a bundle state, the stacking height varies. For example, when plural envelopes each including a glue longitudinal margin at its widthwise center (e.g. a general envelop) are stacked in the bundle state, the center rises. When side corner of the envelope are accordion folded (e.g. a medicine envelope) to increase an inclusion amount, the thickness of each of the sides becomes twice larger than that of its center, so that a center of the envelope becomes extraordinary thin in comparison with the envelope sides when stacked in the bundle state. When a stacked bundle is depressed to decrease the thickness and accordingly thickness variation as well as the volume thereof, a performance of separating the envelopes deteriorates.

The Japanese Registered Patent No. 3,542,689 attempts such that a stack use bottom plate is longitudinally divided into plural pieces to be separately pushed up by springs, respectively, so that the topmost surface of a bundle of medicine envelopes pressure contacts a conveyance roller at the leading end in the sheet feeding direction. In such a medicine envelope feeder, to separate and convey the envelopes from the bundle one by one, the bundle needs to uniformly pressure contact the conveyance roller in the axial direction of the conveyance roller. However, in such a separate bottom lift up system, when a spring coefficient is different from others and the envelope bundle decreases, a height of each of the bottom plates gradually becomes different from the other. As a result, a pressure contact force of the envelope stack against the conveyance roller made by bottom plates becomes uneven, so that qualities of separation and conveyance of the stacked envelope deteriorate.

Further, due to the above-mentioned difficulty, the separate bottom lift up system can not employ a system widely used in a sheet feeding device of an electro-photographic image forming apparatus, in which a leading end of the topmost surface of a sheet bundle is held at a prescribed height and is separated and conveyed by a pick up roller and a sheet feed roller. Specifically, when plural sheet feeding cassettes each having the spring system bottom plate separation construction are piled up, and a stack height detection device is arranged in the vicinity of the pick up roller arranged almost at the widthwise center, the stack height of medicine envelopes becomes lower at the center than its both side ends. As a result, the both side ends contact the bottom plate of the sheet-feeding tray arranged above even the stack height detection device recognizes the height as being appropriate. Specifically, the envelope bundle sometimes causes a problem of separation and conveyance, such as deformation of the bottom plate, breakage of a lifting device, etc., in the worst case.

SUMMARY OF THE INVENTION

Accordingly, an object of the present invention is to improve such background arts technologies and provides a new and novel sheet-feeding tray. Such an new and novel sheet feeding tray includes a frame member, and freely upwardly swingable plural bottom plates arranged on the frame member side by side perpendicular to a sheet feeding direction. The bottom plates cooperatively support a stack of envelope recording mediums. A lifting device having plural curvature sections is provided. The plural curvature sections are respectively arranged below the bottom plates to scuff and lift the lower surface of the plural bottom plates at a section downstream of the sheet feeding direction.

The plural curvature sections each include a different outline in accordance with a difference of a decreasing amount of a thickness of the stack during sheet feeding. The different outlines enable the topmost surface of the stack to be almost horizontal.

In another embodiment, each of plural bottom plates includes one of a concave and convex portion and a friction-decreasing member on the recording medium stacking surface extending in the sheet feeding direction.

In another embodiment, the lifting device includes one of a concave and convex portion and a friction decreasing member on the surface of the curvature section scuffing the bottom plates.

In yet another embodiment, the width of the most downstream end in the sheet feed direction of each of the plural bottom plates is different from that at a portion scuffing the bottom plate.

In yet another embodiment, the swinging center of one of the at least two bottom plates is different from the other.

In yet an other embodiment, each of the plural bottom plates includes one of a concave and convex section or a hole engageable with the lifting member at the upstream end in the sheet feed direction.

In yet another embodiment, the lifting member is formed from a single member.

In yet another embodiment, the lifting member includes at least two cams and a rotational shaft fitting into the at least two cams, each of said at least two cams including a fitted position.

ADVANTAGE

According to one embodiment of the present invention, even if a stacking height, and accordingly, a number of large envelope like recording mediums decreases, the height of the topmost surface of the envelope like recording mediums can be constant at its leading section enabling stable separation and conveyance. As a result, a freedom of arrangement of a height detection sensor can be increased while avoiding damage of a lifting device and deformation of a bottom plate.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF PREFERRED EMBODIMENTS

Figure 1:
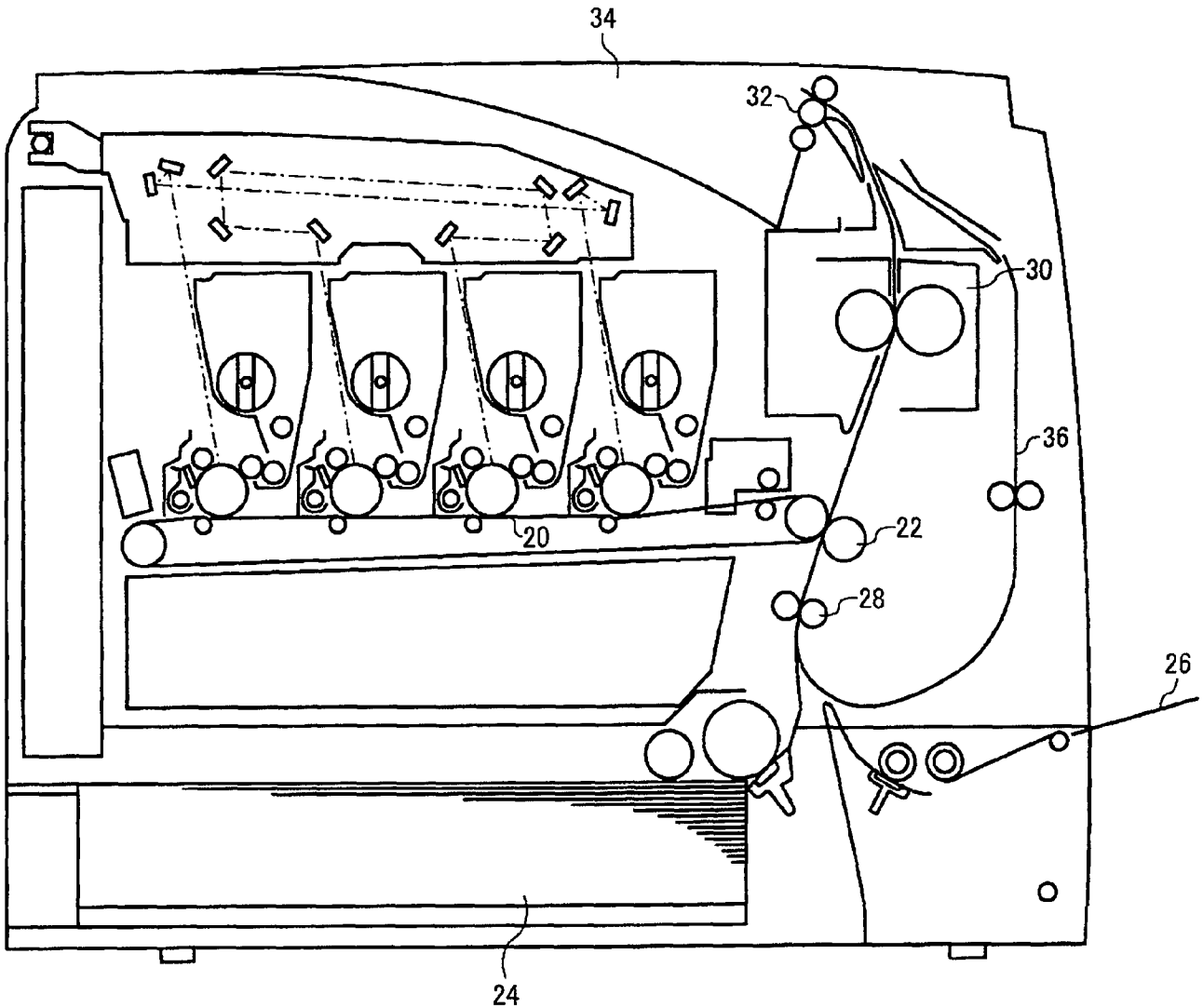
FIG. 1 schematically illustrates a construction of an exemplary image forming apparatus.

Referring now to the drawing, wherein like reference numerals designate identical or corresponding parts throughout several views, In particular in FIG. 1, an outline of an image forming apparatus of a laser printer including a sheet feed tray according to one embodiment of the present invention is described. As shown, in an image formation section including a photoconductive member, an exposure device, and a developing device or the like, an image formed by an electro-photographic system is primarily transferred onto an intermediate transfer belt 20. At a second transfer section, the image is transferred by a second transfer roller 22 pressure contacting the intermediate transfer belt 20 onto a recording medium. When detected by a detection device, not shown, at a sheet feed start position, a recording medium is launched by a sheet feeding mechanism from one of a sheet cassette 24 and a manual sheet feed tray 26 to the second transfer section via a pair of registration rollers 28. After having been subjected to a transfer process, the image is fixed by a fixing device 30 and is ejected onto a sheet ejection tray 34 by a sheet ejection roller 32 when a simplex image is formed. Whereas when a duplex image is formed, the recording medium having the fixed image on its one side is fed again via a sheet inversion device 36 and is led to the second transfer section. Then, the other side is subjected to image transfer and fixing process is ejected onto the sheet ejection tray 34.

Figure 2:
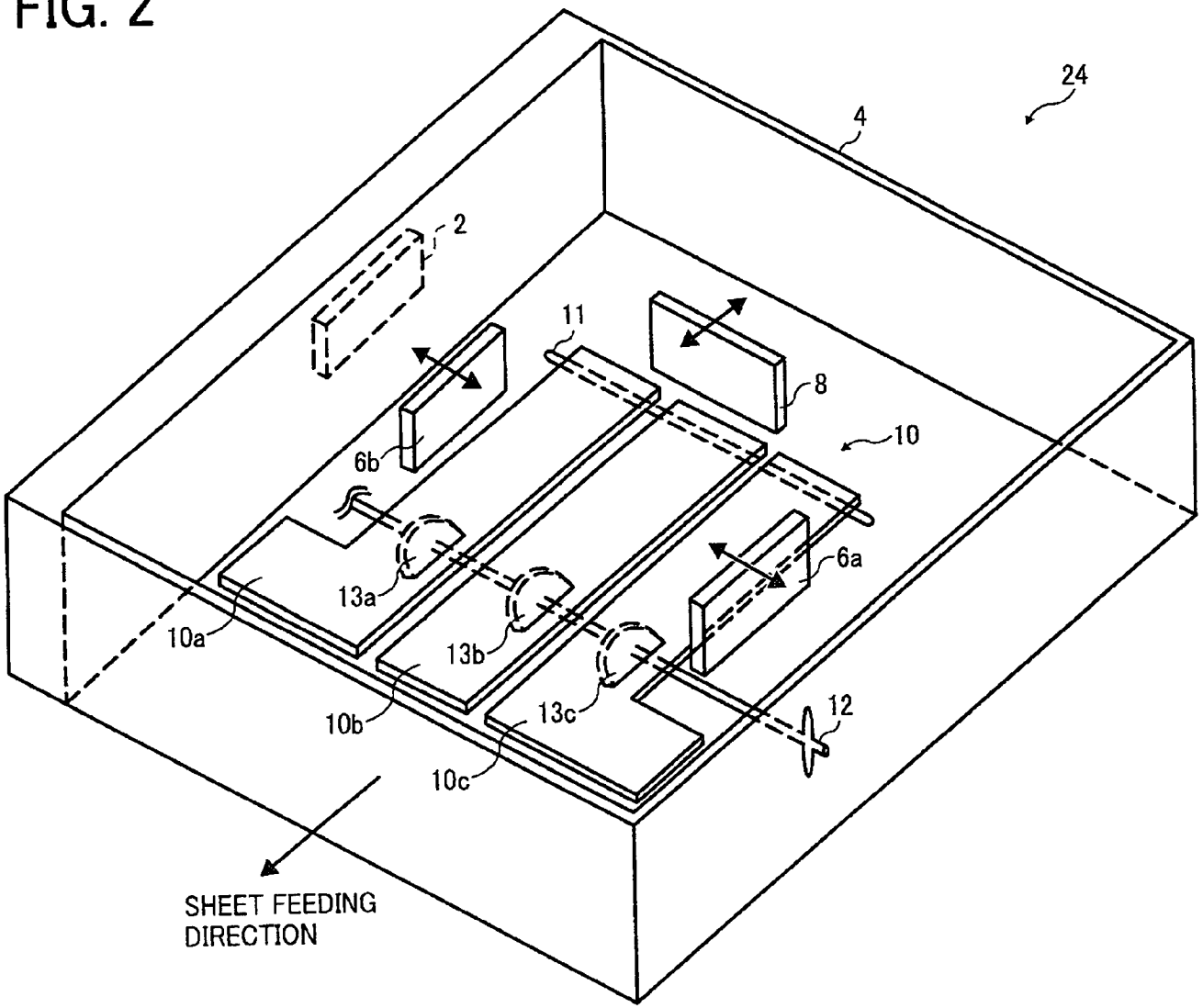
FIG. 2 illustrates an exemplary sheet feed tray according to one embodiment of the present invention.

Now, the sheet feeding cassette 24 having an envelope like recording medium use sheet feed tray is described according to one embodiment of the present invention with reference to FIG. 2. The sheet feeding cassette 24 includes a frame member like tray body 4 having a handle section 2, a pair of side fences 6*a* and 6*b* slidably supported on the tray body 4, and an end fence 8 freely slidably supported by the tray body 4 at both front and the rear sides in the sheet feeding direction. Also included is a swingable bottom plate 10 supported by a pin on the tray body 4 at its base end to mount a stack of recording mediums. Further included is a cam structure arranged below the bottom plate 10 for pressurizing a leading end of a stack of recording mediums against a pick up roller, not shown.

Figure 3:
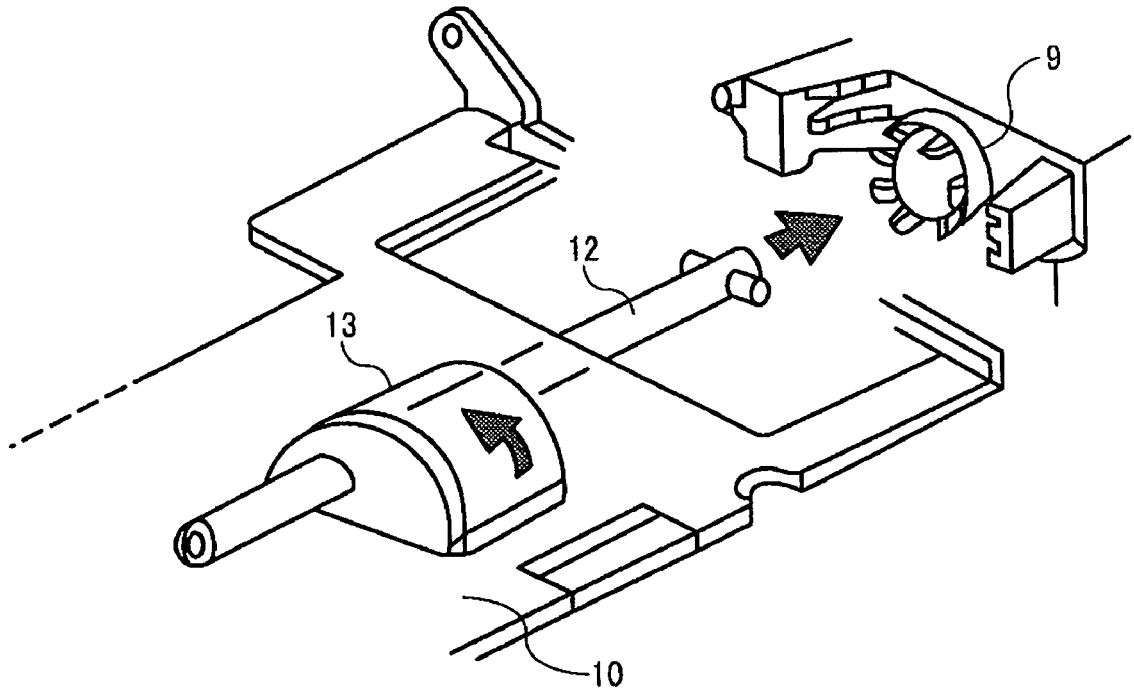
FIG. 3 is conceptual chart illustrating an exemplary bottom plate lifting mechanism.

The bottom plate 10 is divided into three bottom plate pieces 10A to 10C in a sheet cassette widthwise direction. Each of these bottom plate pieces 10A to 10C is commonly attached to the tray body 4 by a supporting pin 11 as a swingable center at their base end, so that each of front sides thereof is upwardly movable around the supporting pin. A lifting device for upwardly moving the bottom plate includes a camshaft 12 and plural disc cams 13*a* to 13C secured and penetrated by the camshaft 12. The disk cams 13A to 13C each includes a prescribed shape corresponding to each of the bottom plate pieces 10A to 10C, wherein two of those (13A and 13C) are common. When the sheet cassette 24 is inserted into the apparatus body, the camshaft 12 engages with a coupling of a gear-attached motor 9 as shown in FIG. 3 so that the bottom plate can be lifted. When the disc cam 13 rotates as the camshaft 12 rotates, the bottom plate pieces change their rotation angles along the lines of the outer circumferential sections of respective disc cams (e.g. prescribed outlines) contacting a bottom plate.

Figure 4A:
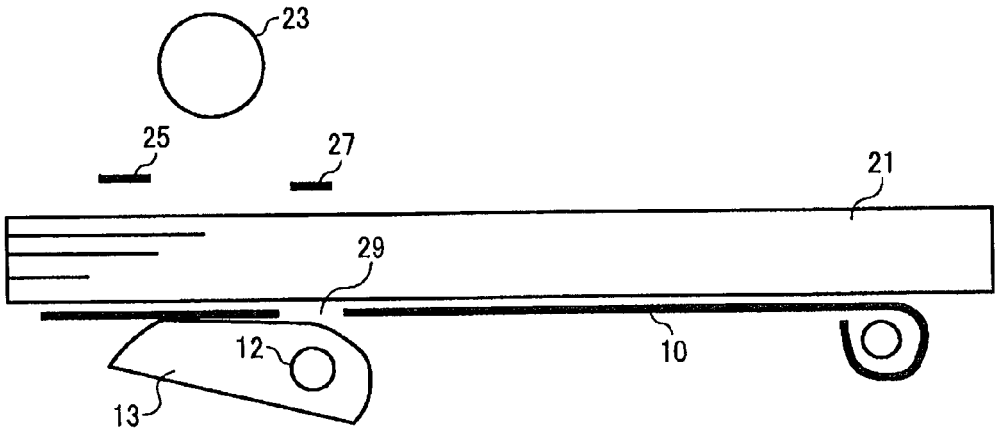
FIG. 4A illustrates an exemplary condition of a bottom plate when a bottom plate lifting operation starts.
Figure 4B:
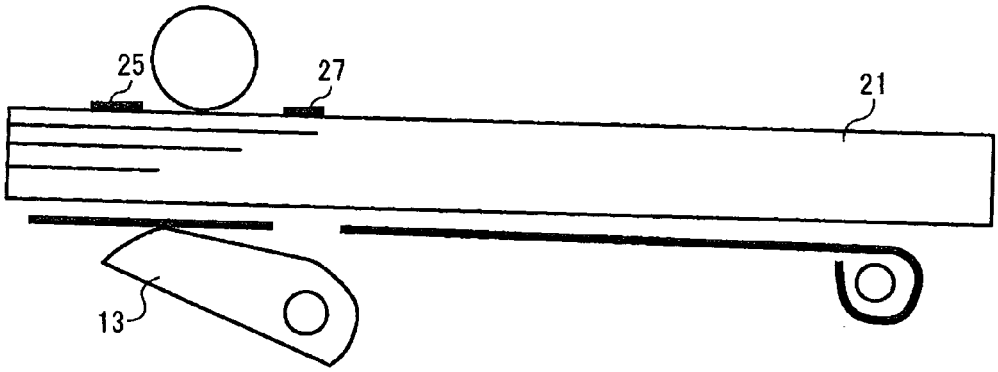
FIG. 4B illustrates an exemplary condition of the bottom plate when sheet feeding starts.

Now, a lifting operation of the bottom plate pieces accompanying the rotation of the disc cam is described with reference to FIG. 4, wherein a bottom plate is lifter and detected by a detection device. When the bottom plate is located at the lowest position as shown in FIG. 4A and a power is supplied and the detection device detects presence of the sheet cassette (the tray) in step S1, the gear-attached motor 9 starts rotating and drives the disc cam 13 via the camshaft 12 and swings the bottom plate 10, so that the recording medium is lifted up. When the bottom plate swings and the topmost surface of the stack of the recording mediums reaches a prescribed position and the effect is detected by a first filler 25 constituting a upper surface detection device in step S2 and a second filler 27 constituting a recording medium detection device in step S3, the driving device stops driving as shown in FIG. 4B. Thus, a prescribed pressure is always applied to the pick up roller 23 at the stopping position. When the pick up roller 23 rotates, the sheet-feeding roller conveys the recording medium to the pair of registration rollers 28. As mentioned, FIG. 4B illustrates a condition where the bottom plate 10 is lifted and the recording medium 21 is ready for sheet feeding. Herein after, an operation starting from when the cam shaft 12 rotates from the bottom plate lowermost position of FIG. 4A to when it stops in a condition as shown in FIG. 4B is called a sheet lifting operation.

Figure 4C:
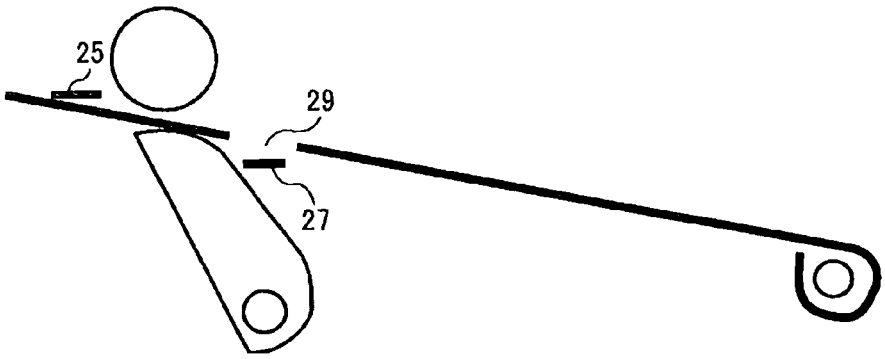
FIG. 4C illustrates an exemplary condition of the bottom plate when a recording medium is absent.
Figure 5:
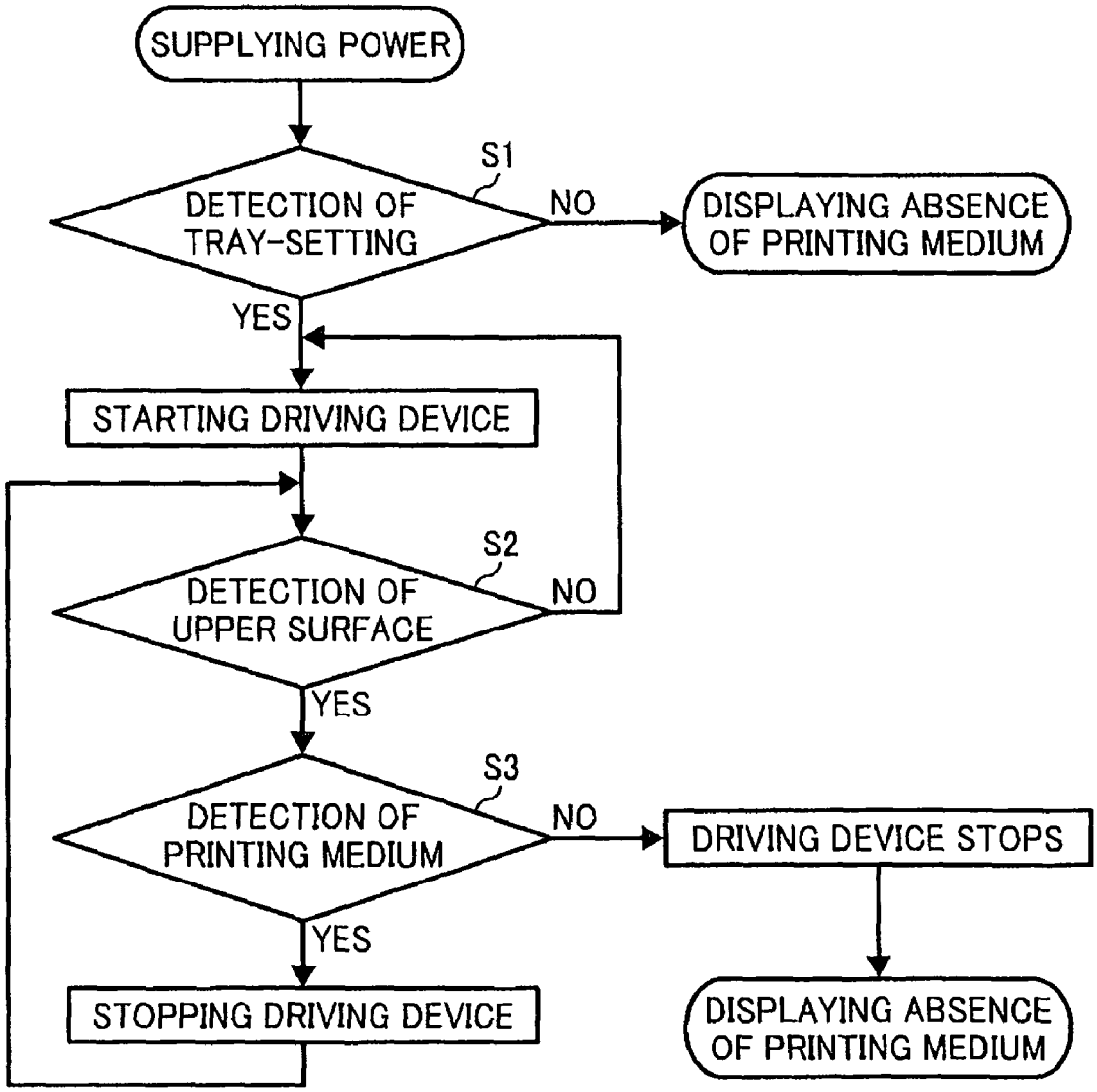
FIG. 5 is a chart illustrating an exemplary sequence of bottom plate lifting.

When the recording medium is conveyed to the image formation section, and the upper surface of the stack lowers, the driving device operates and lifts the bottom plate until the upper surface can be detected, because the upper surface detection device detects nothing. As far as the recording mediums remain on the bottom plate, lifting and non-lifting of the bottom plate are repeated. As shown in FIG. 4C, when no recording medium exists on the bottom plate, the second filler 27 slips into a detection hole 29 formed on the bottom plate and positions therebelow, and detects that the recording medium has gone from the bottom plate. Such an effect is then displayed on an operation section, not shown. When an operator attempts to withdraw the sheet cassette from the apparatus body, a coupling between the cam shaft 12 and the driving device disengages with the camshaft 12 of the sheet cassette, and the bottom plate returns by its gravity to the lowest position, so that the sheet cassette can be detached.

Figure 6:
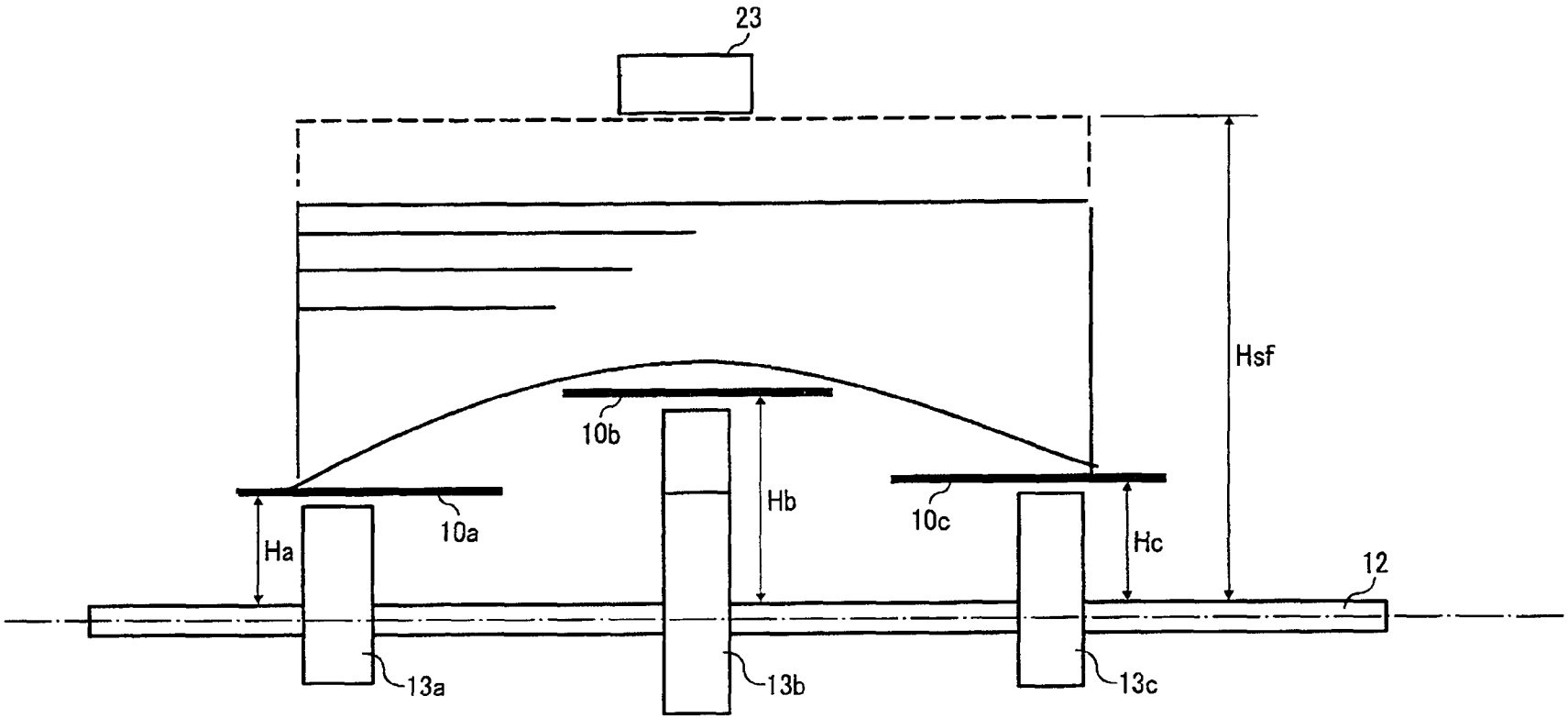
FIG. 6 is a chart illustrating an exemplary variation of a stacking height of envelope like recording mediums in a widthwise direction appearing when stacked.
Figure 7:
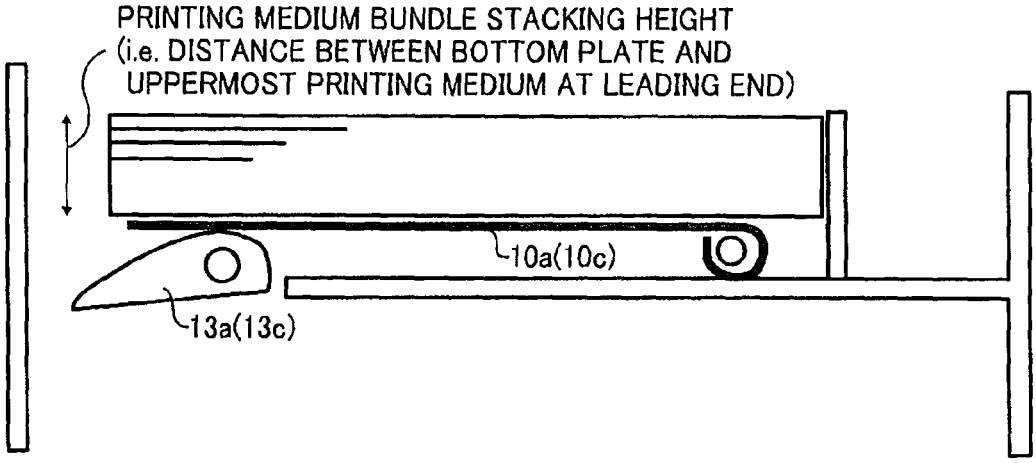
FIG. 7 is a side elevation view illustrating an exemplary stacking condition at a section where a lot of envelope like recording mediums overlap.
Figure 8:
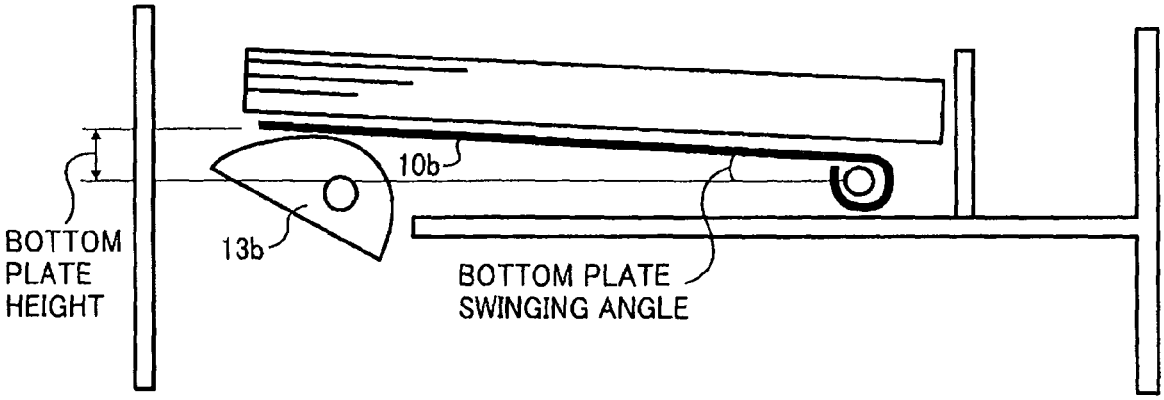
FIG. 8 is a side elevation view illustrating an exemplary stacking condition at a section where a few envelope like recording mediums overlap.

Now, an exemplary outline shape of the outer circumferential scuffing section of the disc cam having a function of lifting the bottom plate piece is described. Herein below it is premised that thickness variation of envelope like recording mediums is symmetrical in the widthwise direction when stacked. At that moment, as recognized from FIG. 6, a thickness of stack varies in the widthwise direction, and accordingly, each of the leading ends of the bottom plate pieces 10A and 10C supporting the recording medium take lower positions (Hc=Ha) as shown in FIG. 7, while the central bottom plate piece 10B takes a higher position (Hb) (also see FIG. 8). Legend Hsf represents an upper surface of the recording medium when sheet feed starts.

The image forming apparatus controls the camshaft 12 to rotate so that the upper surface comes to the height Hsf. Herein below, it is premised that the camshaft and the bottom plate-swinging shaft are arranged on the same level and a thickness of the bottom plate is neglected.

The outline shape of the disc cams contacting and lifting the bottom plate pieces meets the following condition at the outer circumferential scuffing sections when the rotation angle of the camshaft theta (θ) is zero, i.e., the bottom plate exists at the lowest position;

Hb0 (Height of the bottom plate piece 10B)>Ha0 (Height of the bottom plate pieces 10*a*, 10*c*)

Figure 9A:
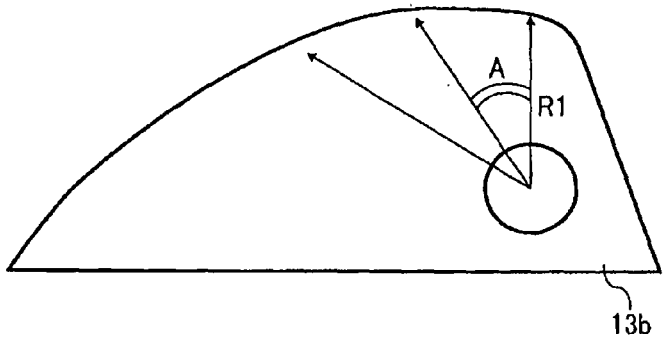
FIG. 9A is a chart illustrating an outer circumferential outline of a disc cam arranged at a thinner portion of the stack.
Figure 9B:
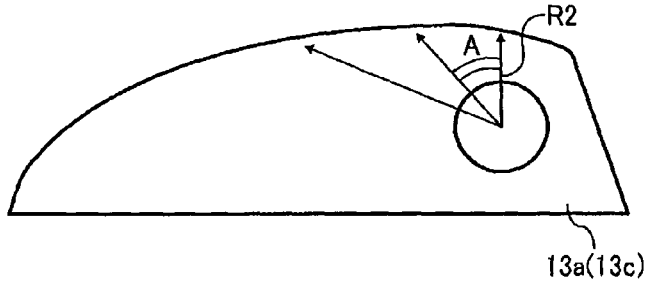
FIG. 9B is a chart illustrating an outer circumferential outline of a disc cam arranged at a thicker portion of the stack.

When the rotation angle of the camshaft theta is maximum (θ=θmax), all of the heights of the bottom plate pieces 10*a* to 10*c* amounts to Hsf. As the rotation angle of the camshaft changes from zero to maximum, the cam outer circumference needs to increase a distance between the scuffing portion and the camshaft. For example, the change shows a clothoid curve gradually increasing a distance. For example, the outline shape is shown in FIG. 9 meeting the following formulas, wherein "A" represents a rotation angle of curvature radius, alpha 1 and 2 represent increase rates of the curvature radius:

Disc cam 13*b*: $R1=\text{alpha}1\times A+Hb0$

Disc cam 13*a*: $R2=\text{alpha}2\times A+Ha0$

The increase rates of the curvature radius correspond to changes of a thickness at the center and both sides from when the stack of envelope like recording mediums is maximum to when the last recording medium remains. Such increase rates are previously experienced as follows:

Alpha 1:Alpha 2=1:2

Figure 10:
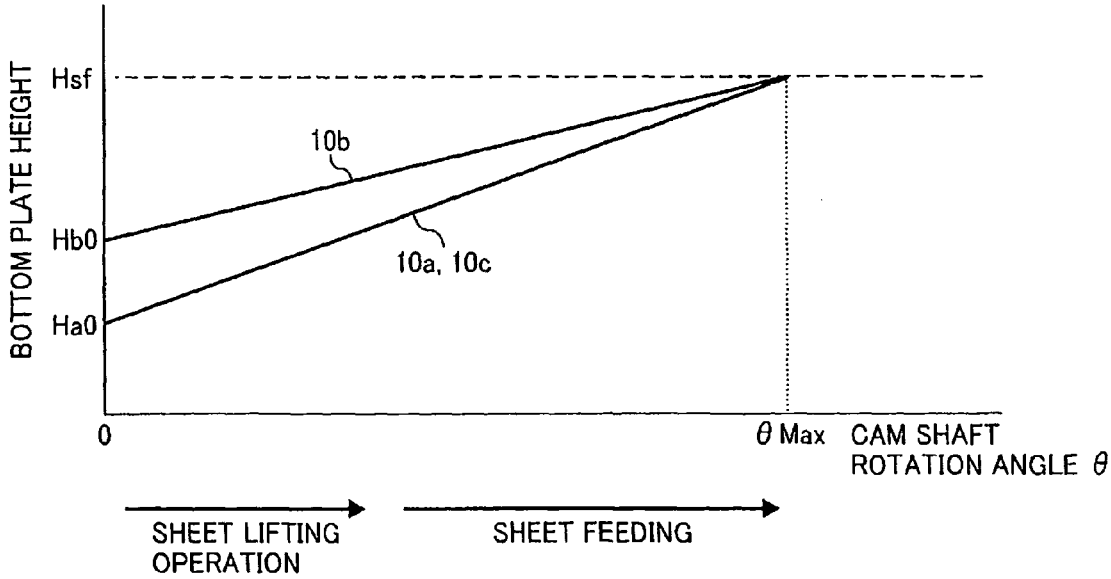
FIG. 10 is a graph illustrating a relation between a swinging angle and a height of a leading end of the bottom plate which uniquely changes in accordance with a difference of an outline of an outer circumference of a cam contacting a bottom plate when recording mediums are not stacked and a central bottom plate piece is higher than others.
Figure 11:
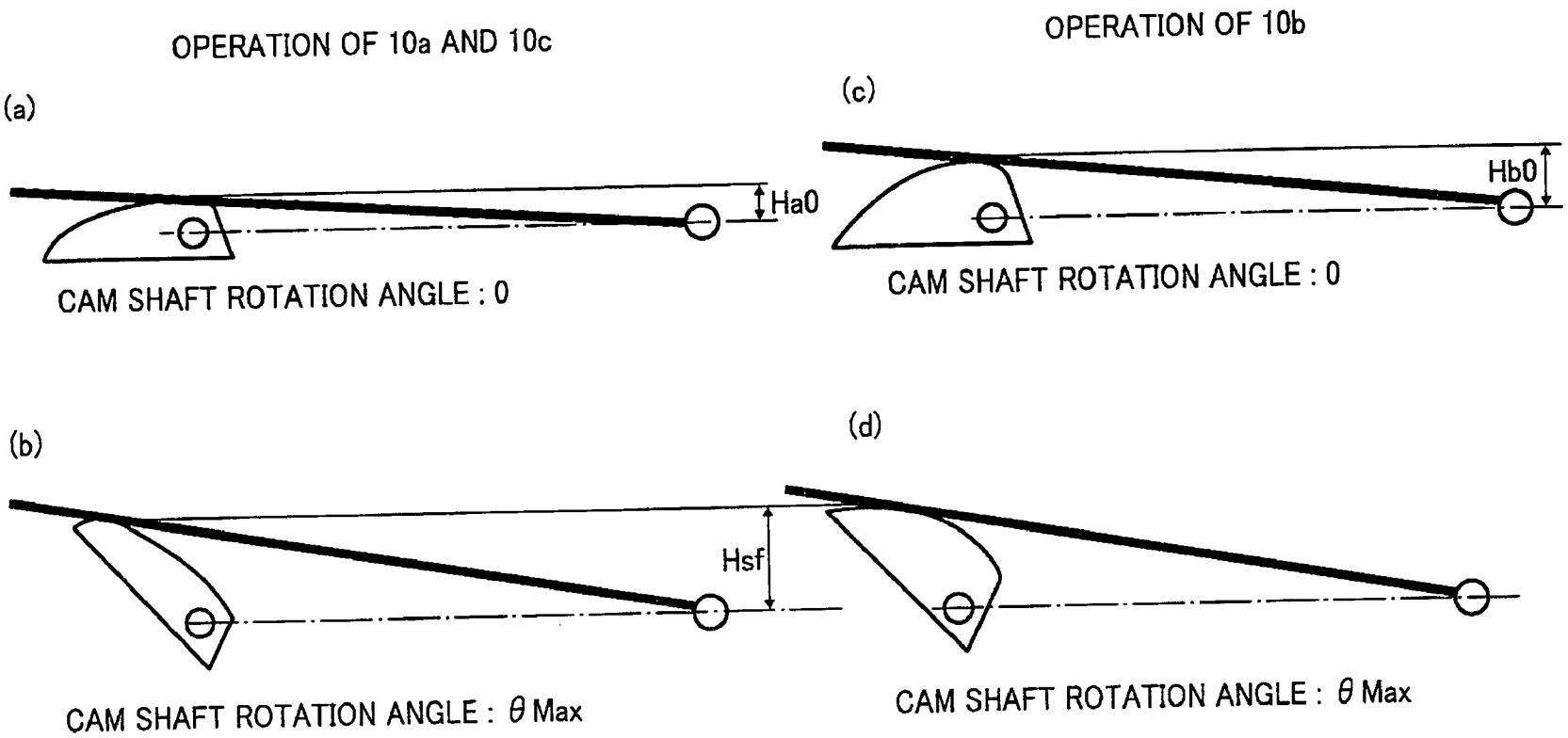
FIG. 11A is a chart illustrating a condition where a bottom plate piece start rising as a cam shaft rotates from when a cam shaft rotation angle is zero and the bottom plate piece supporting a thicker side of a stack of recording mediums is positioned lowest.
FIG. 11B is a chart illustrating a condition where the shaft rotation angle is maximum while the bottom plate piece supporting a thicker side of the stack of recording mediums is positioned highest.
FIG. 11C is a chart illustrating a condition where the camshaft rotation angle is zero and the bottom plate piece supporting a thinner side of the recording medium is positioned lowest.
FIG. 11D is a chart illustrating a condition where the cam shaft rotation angle is maximum and the bottom plate supporting the thinner side of the stack of recording mediums is positioned highest.

When respective disc cams including an outline of FIG. 9 are used, the leading end height of the bottom plate piece 10*b* is higher than that of the leading end height of both sides of the bottom plate pieces 10*a* and 10*c* when the envelope like recording mediums are not stacked. A relation between the camshaft rotation angle theta (θ) and the bottom plate height established from when the stack of the envelope like recording mediums is lifted to when the topmost recording medium bundle contacts and fed by the pickup roller is illustrated in FIG. 10. Exemplary conditions of respective bottom plate pieces when the camshaft rotation angle is both zero and maximum are illustrated in FIG. 11.

Depending on a cam shape, a contact position on the bottom plate largely deviates as the cam rotates, and the height of the bottom plate cannot correspond to the outline of the cam. In such a situation, by providing a convex shape to the can contact section on the bottom plate, deviation of the contact position is suppressed and the change in the height of the bottom plate can correspond to the outline of the cam.

Figure 12:
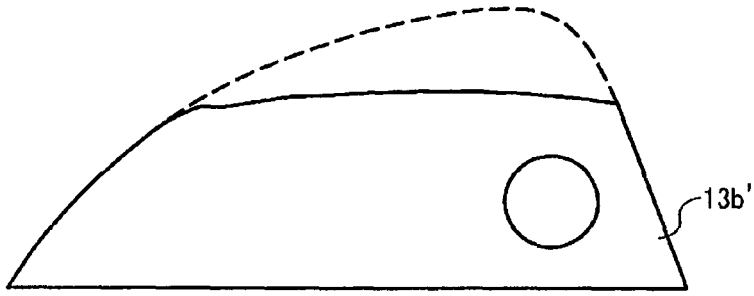
FIG. 12 is a chart illustrating a modification of the cam arranged on the thinner side of the stack of recording mediums capable of aligning the height of all of the bottom plate pieces when the recording medium are not stacked.
Figure 13:
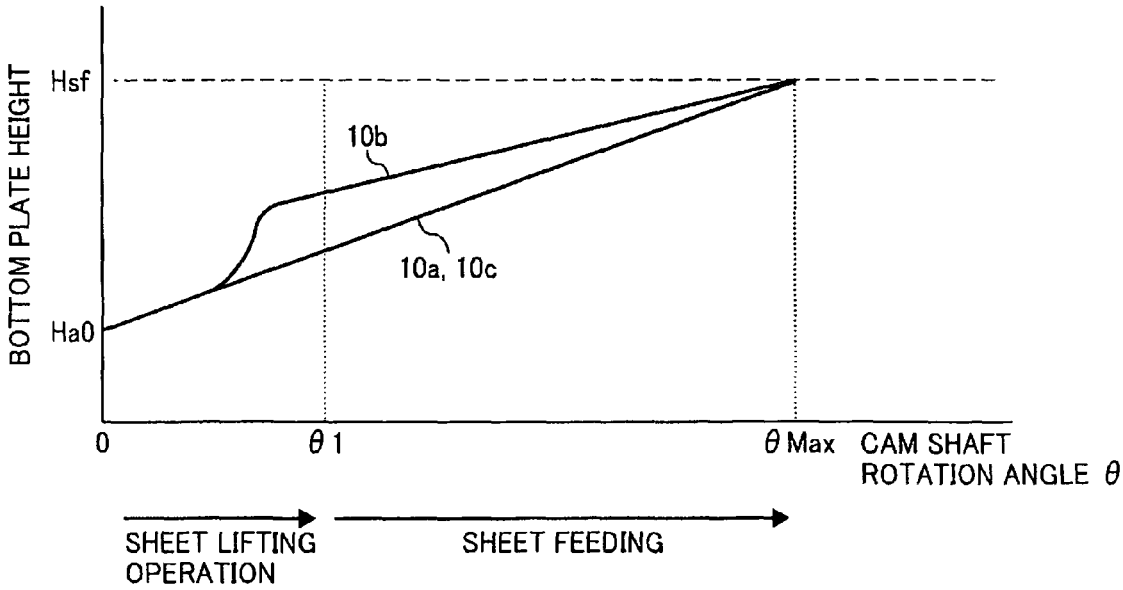
FIG. 13 is a graph illustrating a condition where a relation between a change of a swinging angle and a height of a leading end of the bottom plate uniquely changes in accordance with a difference of an outline of an outer circumference section of a cam contacting a bottom plate when the height of the bottom plate pieces are aligned and recording mediums are not stacked.
Figure 14:
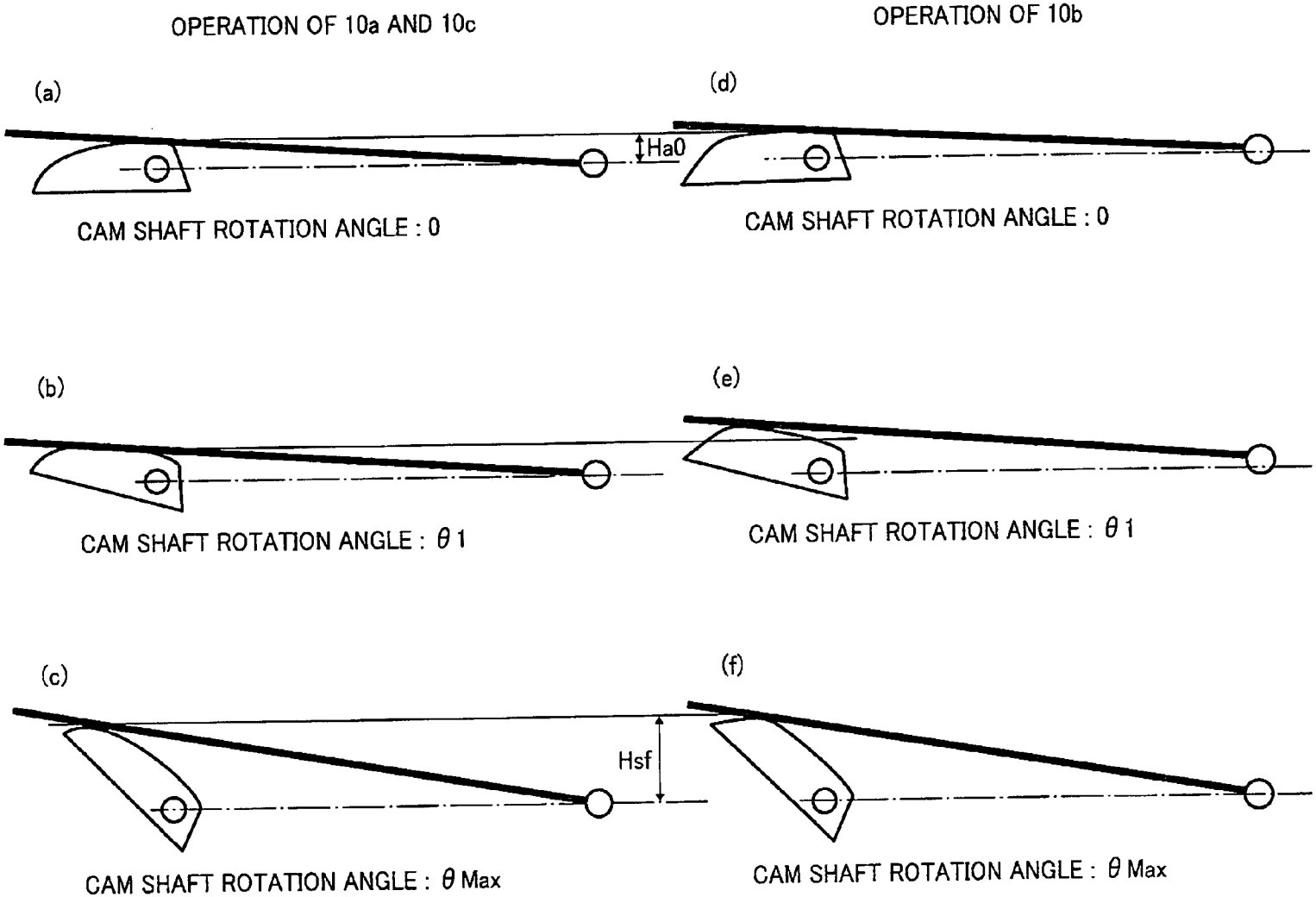
FIG. 14A is a chart illustrating a condition where a bottom plate piece start rising as a cam shaft rotates from when a cam shaft rotation angle is zero and a bottom plate piece supporting a thicker side of a stack of recording mediums is positioned lowest.
FIG. 14B illustrates an exemplary condition of the bottom plate when sheet feeding starts.
FIG. 14C is a chart illustrating a condition where the cam shaft rotation angle is maximum while the bottom plate piece supporting a thicker side of the stack of recording mediums is positioned highest.
FIG. 14D is a chart illustrating a condition where the camshaft rotation angle is zero and the bottom plate piece supporting the thinner side of the stack of recording mediums is positioned lowest.
FIG. 14E illustrates an exemplary condition of the bottom plate when sheet feeding starts.
FIG. 14F is a chart illustrating a condition where the cam shaft rotation angle is maximum and the bottom plate piece supporting the thinner side of the stack of recording mediums is positioned highest.

When no recording medium exists and the heights of the bottom plate pieces are not the same with each other, the recording mediums are hardly set correctly. Then, the height should be aligned by shaping the cam for central bottom plate piece use by cutting away the upper side thereof as shown in FIG. 12. A relation between the camshaft rotation angle theta (θ) and the bottom plate height established when the stack of the envelope like recording mediums is lifted and the topmost recording medium contacts and fed by the pickup roller while using the above-mentioned central bottom plate piece use cam is illustrated in FIG. 13. Exemplary conditions of respective bottom plate pieces when the camshaft rotation angle is zero, and the sheet feed start time angle theta1 (θ1), as well as the maximum angle (θmax) are illustrated in FIG. 14.

As mentioned heretofore, height variation of the stack of the envelope recording mediums can be corrected and the topmost surface of the recording mediums in the sheet feed front side can be held flattened. With provision of plural disc cams having a different outer circumferential scuffing outline, the relation between the bottom plate angle and the bottom plate height shown in FIG. 2 can be appropriately changed in accordance with a type of the envelope like recording medium. In this example, the disc cam and the camshaft are used as a bottom plate-lifting device. However, the other lifting member can be employed as far as it includes an outline corresponding to a change in a thickness of an envelope like printing mediums. For example, a curvature outline can be formed on an arm piece integral with the rotation shaft as mentioned later in detail with reference to FIG. 20 to correspond to the change of the thickness of the envelope like printing mediums.

Figure 15:
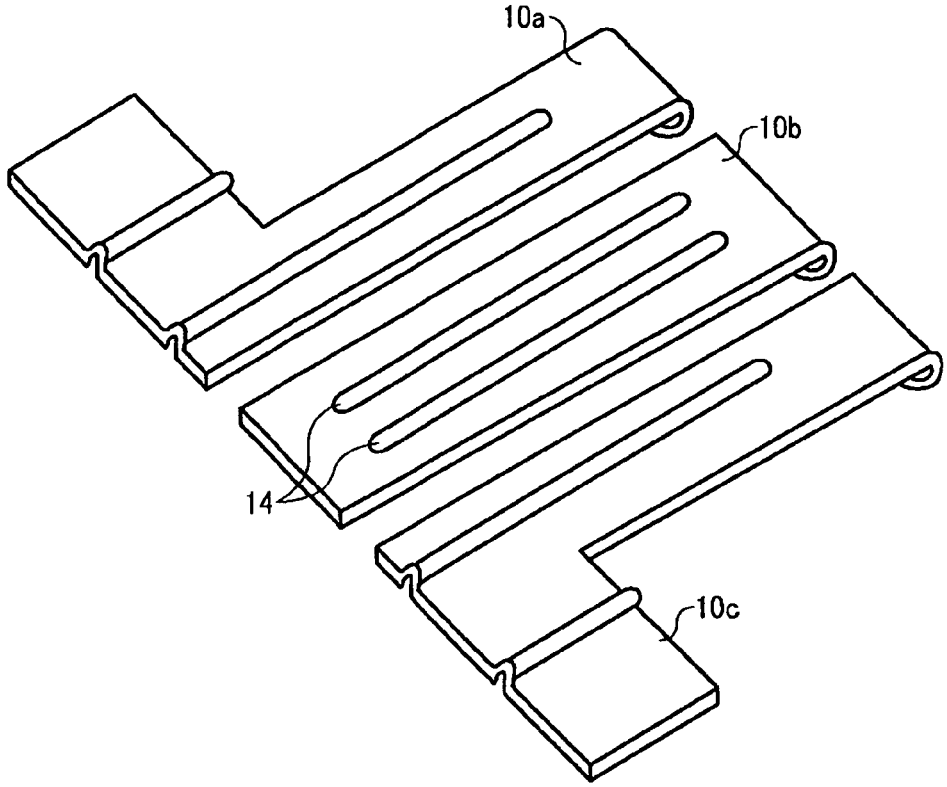
FIG. 15 is a perspective view illustrating a modification of a combination of bottom plate separated pieces.
Figure 16:
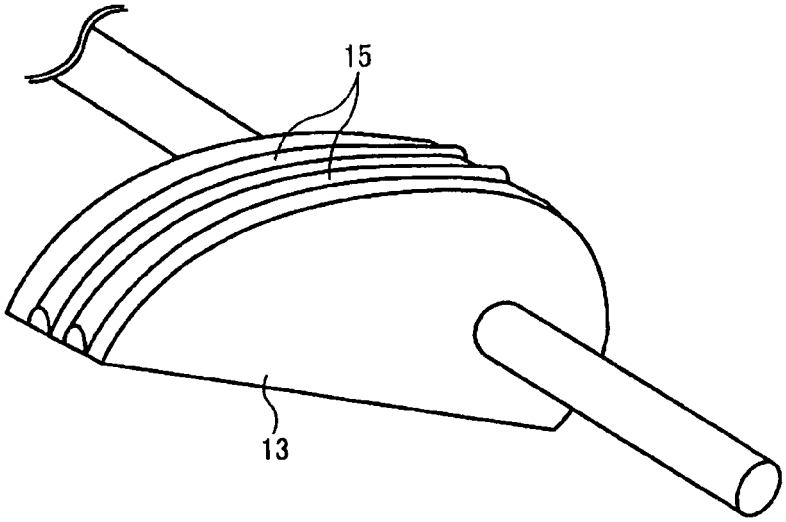
FIG. 16 is a chart illustrating an exemplary cam member including a cam-scuffing surface having convex and concave portions arranged in parallel to a sheet feeding direction.

Now, a modification of division bottom plate piece combination is described with reference to FIG. 15. To reduce conflicting force between stacked recording mediums and a bottom plate, convex beads 14 are provided on the bottom plates 10*a* to 10*c*. However, instead of the beads, confliction reduction members can be attached. Similarly, convex beads can be provided on the rear side of the bottom plates 10*a* to 10*c*, i.e., on the side of the bottom plate-lifting device (i.e., cam) to reduce lifting between the bottom plate and the bottom plate elevation device. Specifically, by arranging the convex beads 15 on the outer circumferential scuffing surface of the cam 13, scuffing confliction caused on the bottom plate is reduced. Instead of the bead, a miler (a name of commodity) sheet, a Teflon™ sheet and the like can be attached.

Figure 17:
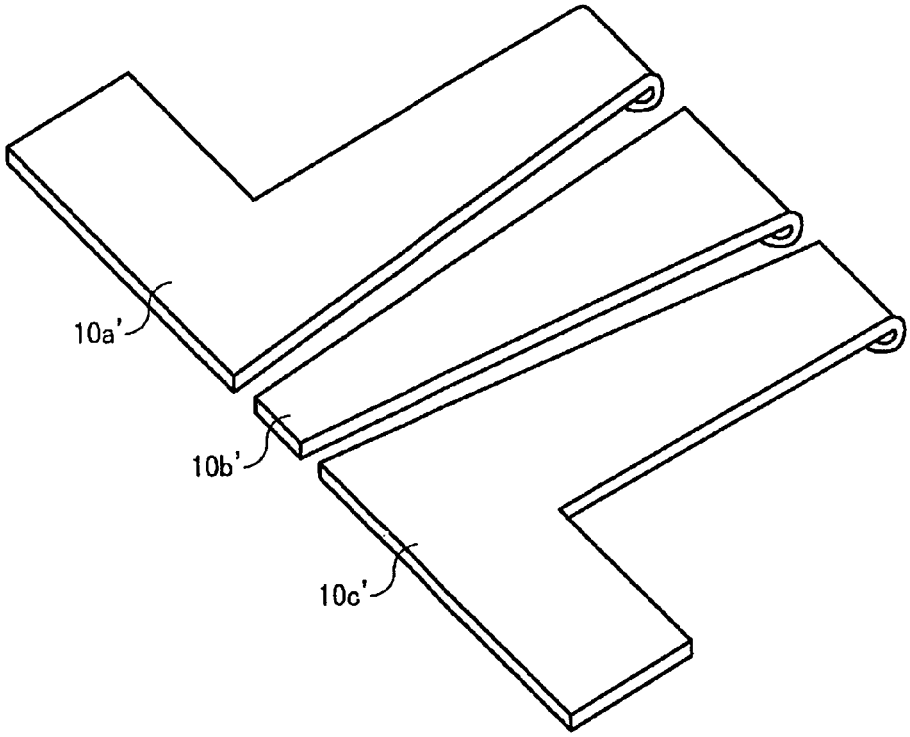
FIG. 17 is a perspective view illustrating another modification of a combination of separated bottom plate pieces.

Now, yet another modification of the division bottom plate piece combination is described with reference to FIG. 17. The central bottom plate piece 10*b*' becomes sharp at a tip more than the base end. In accordance with the shape of the central bottom plate piece 10*b*', the side end use bottom plate pieces 10*a*' and 10*c*' become wider toward their tips. With such a shape, when a curled radius of a stack of envelope like recording mediums is small, a close contact performance of the central bottom plate piece 10*b*' relation to the central region of the stack can be improved.

Figure 18:
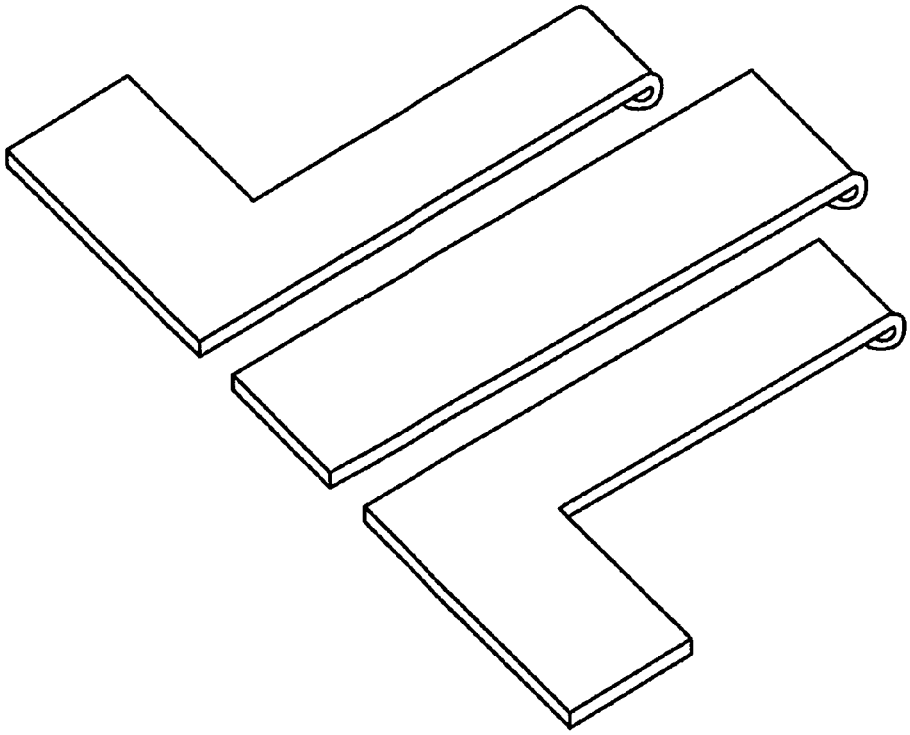
FIG. 18 is a perspective view illustrating yet another modification of a combination of separated bottom plate pieces.

Another modification of the division bottom plate piece combination of FIG. 18 shows a construction in that a rotational center of one of bottom plate pieces is differentiated from the above-mentioned modifications. In contrast to the drawing, the central bottom plate piece can be shorter. Thus, by changing the rotational center of the bottom plate piece different from that rotating around the same axis, a relation between a rotation angle and a height can be changed even if the same disc cams are used as mentioned earlier.

Figure 19:
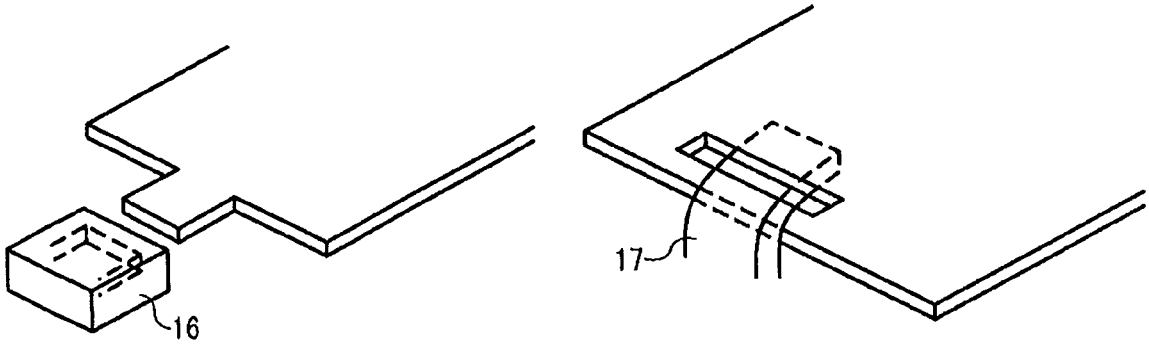
FIG. 19 is a chart illustrating an exemplary bottom plate piece swingably attached to a tray body having a base end side shaped to fit into either a concave piece or a convex hook formed on the tray body.

FIG. 19 illustrates an attempt for simplifying an assembling operation for assembling a bottom plate and a sheet feed tray. Specifically, one of a convex or concave section and a hole is formed on a bottom plate piece at its base end to fit into a concave piece 16 or a convex hook 17 formed on a tray body. Thus, the fitting section serves as a rotation center of the bottom plate.

Figure 20:
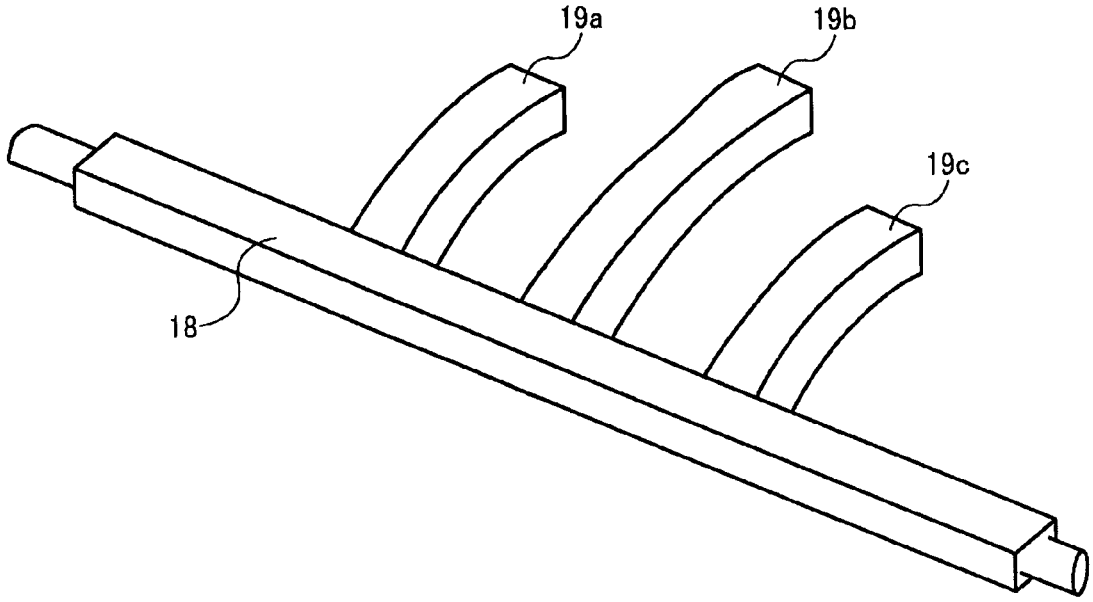
FIG. 20 is a perspective view illustrating an exemplary an arm like curvature piece integrally formed on a rotation shaft of the bottom plate-lifting device for lifting the bottom plate by scuffing the lower surface thereof.

FIG. 20 illustrates an example, in which plural arm like curvature pieces 19*a* to 19*c* are provided integral with a rotation shaft 18, which is included in a bottom plate lifting device 18, to lift the bottom plate while scuffing the lower surface of the bottom plate. The plural arm like curvature pieces 19*a* to 19*c* are made of the same material such as iron, brass, aluminum, etc., and resin, ABS, POM, and PC resin. A curved outlines of the arm like curvature pieces correspond to changes in a thickness of each of corresponding positions of envelope like printing mediums.

Figure 21:
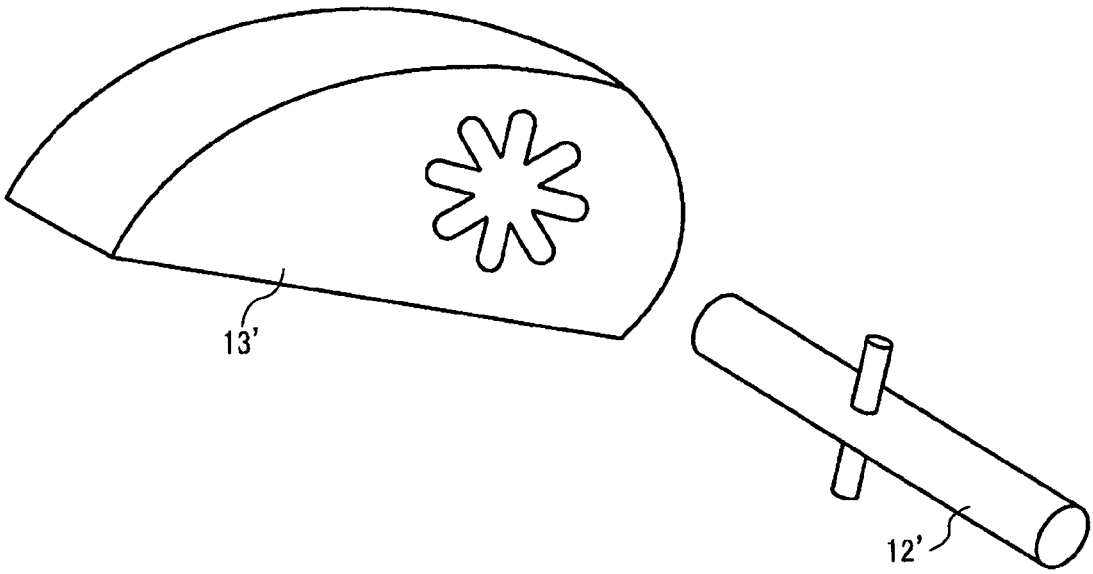
FIG. 21 is a perspective view illustrating an exemplary can having plural fitting positions around the cam shaft circumferential direction.

The outline shape of the outer circumferential scuffing section of the cam member for lifting the bottom plate is determined to uniquely change a bottom plate leading end as the bottom plate changes its rotation angle, and is thus different in accordance with a type of an envelope like recording medium. However, it is experienced that a process of the outline change is almost the same even when a type of recording medium is different and the thickness of the stack varies. Then, a structure capable of changing a fitting position of a shaft fitting into a cam member in a rotation direction is changed as described with reference to FIG. 21.

As shown, a concave and convex section is formed around a shaft hole on a cam member 13' and engages with a pin section attached to the camshaft 127. After engagement, a securing member, such as an E-letter shaped ring, a stopping ring, etc., prevents a shaft direction movement of the cam member 13'.

Figure 22:
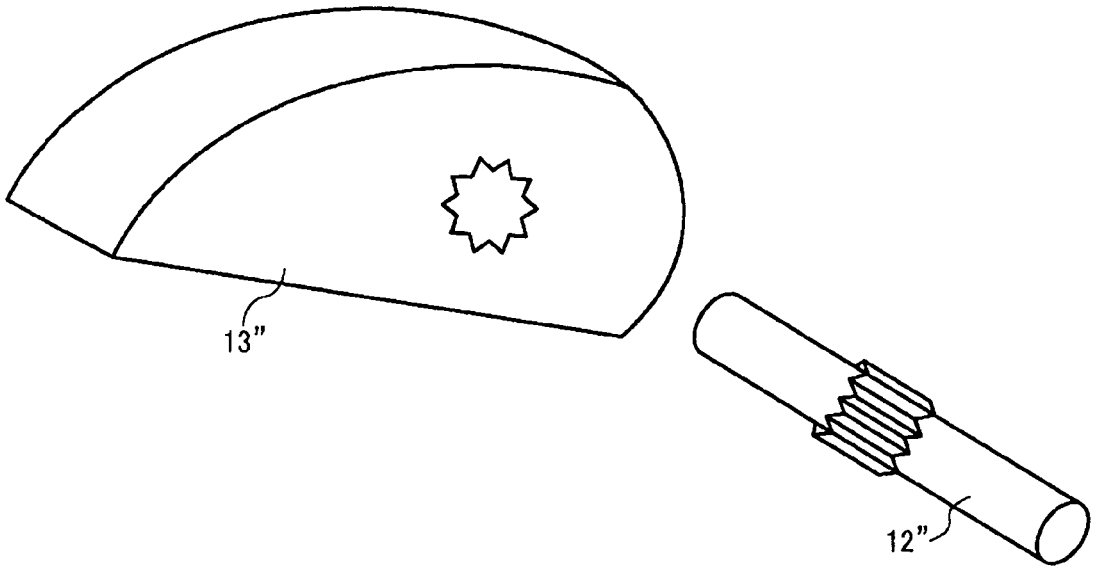
FIG. 22 is a perspective view illustrating another cam having plural fitting positions around the camshaft circumferential direction.

Otherwise, a fastening device can reduce a diameter of the hole of the cam member to prevent the shaft direction movement of the cam member 13'. As shown in FIG. 22, a sprain state groove is formed on a shaft inner surface of the cam member" and is engaged with a sprain state groove formed on the surface of the camshaft 12". Similar to the example as described with reference to FIG. 21, a fixing member such as an E-letter shaped ring, a stopping ring, etc., prevents a shaft direction movement of the cam member 13' after engagement.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A sheet feeding tray, comprising:

a frame member;

at least two freely upwardly swingable bottom plates arranged on the frame member side by side perpendicular to a sheet feeding direction, said bottom plates cooperatively supporting a stack of envelope recording mediums; and a lifting device having at least two curvature sections respectively arranged below the bottom plates and configured to scuff and lift the lower surface of the at least two bottom plates at a section downstream of a trailing end of the at least two bottom plates in the sheet feeding direction;

wherein said at least two curvature sections each includes a different outline in accordance with a difference of a decreasing amount of a thickness of the stack during sheet feeding, said different outlines enabling the topmost surface of the stack to be almost horizontal at leading ends of the bottom plates, and wherein each of the at least two bottom plates includes one of a concave and convex section and a hole engageable with the lifting device at the upstream end in the sheet feed direction.

2. The sheet-feeding tray as claimed in claim 1, wherein each of said at least two bottom plates includes one of a concave and convex portion and a friction-decreasing member on the recording medium stacking surface extending in the sheet feeding direction.

3. The sheet-feeding tray as claimed in claim 1, wherein said lifting device includes one of a concave and convex portion and a friction decreasing member on the surface of the at least two curvature sections.

4. The sheet feeding tray as claimed in claim 1, wherein the width of the most downstream end in the sheet feed direction of each of said at least two bottom plates is different from that at the upstream end.

5. The sheet-feeding tray as claimed in claim 1, wherein the swinging center of one of the at least two bottom plates is different from the other.

6. The sheet-feeding tray as claimed in claim 1, wherein said lifting device is formed from a single member.

7. The sheet-feeding tray as claimed in claim 1, wherein said lifting device includes at least two cams and a rotational shaft fitting into the at least two cams, each of said at least two cams including a fitted position.

8. An image forming apparatus including a sheet feed tray, said sheet feed tray comprising:

a frame member;

at least two freely upwardly swingable bottom plates arranged on the frame member side by side perpendicular to a sheet feeding direction, said bottom plates cooperatively supporting a stack of envelope recording mediums; and a lifting device having at least two curvature sections respectively arranged below the bottom plates and configured to scuff and lift the lower surface of the at least two bottom plates at a section downstream of a trailing end of the at least two bottom plates in the sheet feeding direction;

wherein said at least two curvature sections each includes a different outline in accordance with a difference of a decreasing amount of a thickness of the stack during sheet feeding, said different outlines enabling the topmost surface of the stack to be almost horizontal at leading ends of the bottom plates, and wherein each of the at least two bottom plates includes one of a concave and convex section and a hole engageable with the lifting device at the upstream end in the sheet feed direction.

* * * * *